United States Patent [19]

Hans

[11] 4,398,397

[45] Aug. 16, 1983

[54] SELF-BALANCING TWO STAGE HEAT RECOVERY SYSTEM

[75] Inventor: Walter A. Hans, Cherry Hill, N.J.

[73] Assignee: Penjerdel Refrigeration Co., Inc., W. Conshohocken, Pa.

[21] Appl. No.: 258,030

[22] Filed: Apr. 27, 1981

[51] Int. Cl.[3] ..... F25B 27/02

[52] U.S. Cl. ..... 62/238.6

[58] Field of Search ..... 62/159, 183, 238.6, 62/506, 333, 335; 5/451

[56] References Cited

U.S. PATENT DOCUMENTS

| | | | |
|---|---|---|---|
| 2,150,224 | 3/1939 | Hull | 62/238.6 |
| 2,556,882 | 6/1951 | Minkler et al. | 62/159 X |
| 3,513,663 | 5/1970 | Martin, Jr. et al. . | |
| 4,168,745 | 9/1979 | Lastinger . | |
| 4,171,621 | 10/1979 | Trelease . | |
| 4,226,604 | 10/1980 | Weis . | |
| 4,251,996 | 2/1981 | Esformes et al. . | |
| 4,254,630 | 3/1981 | Geary . | |

*Primary Examiner*—Lloyd L. King

*Attorney, Agent, or Firm*—Finnegan, Henderson, Farabow, Garrett and Dunner

[57] ABSTRACT

A heat recovery system which can be retrofitted onto existing equipment in order to utilize otherwise wasted heat. A heat exchanger used in the heat recovery system is designed to expose a fluid to be heated to a hot heat exchange medium such that the fluid encounters a constantly increasing temperature of the heat exchange medium. The heat recovery system employs flow control devices to compensate for any pressure drops existing in the heat recovery system so as not to degrade the operation of the heat source nor a fluid system while maximizing heat recovery efficiency.

23 Claims, 4 Drawing Figures

SELF-BALANCING TWO STAGE HEAT RECOVERY SYSTEM

FIELD OF THE INVENTION

This invention relates with particularity to a heat exchange apparatus wherein a heated gas or vapor flow is utilized as a energy source and a separate liquid flow is provided in heat exchange relationship with the gas or vapor flow.

BACKGROUND OF THE INVENTION

Over the past few years, the dramatic increase in energy cost and dire predictions of future shortages and upward spiralling energy prices have focused much attention on the need to conserve our present energy resources while developing additional sources for the future. A significant effort within the conservation movement has been centered on designing machines and heating and cooling systems that operate more efficiently. Evidence of the success of such efforts can be found in the increased milage for automobiles and various energy-saving features incorporated in new appliances and machines. Nevertheless, countless machines and heating and cooling systems not incorporating these energy saving features are currently in service and have useful lives extending well into the future. Thus, if such machines and systems can be retrofitted with devices to increase their efficiency or to make use of otherwise wasted energy, the conservation movement will be further promoted.

For example, refrigeration systems, as a general rule, dissipate the heat withdrawn from the medium to be cooled and the compression energy added to the refrigerant gas into the ambient atmosphere. In the past, there have been attempts to recover this wasted heat from the discharge side of the refrigeration systems. Oftentimes, a heat exchanger has been included as an integral part of the refrigeration system as a means for heating another medium. On the whole, these efforts have been unsuccessful because low energy prices have made it economically more feasible to use energy inefficiently than to increase the capital investment in a refrigeration system by including a heat recovery system. Also, many of the heat recovery systems have been inefficient and have boosted the expense of maintaining the refrigeration systems. Thus, there are numerous refrigeration systems in current use that continuously discharge useful energy into the ambient atmosphere, energy which could readily be used to heat, for example, cold water for use as boiler feed water, wash water, etc.

OBJECTS AND SUMMARY OF THE INVENTION

It is an object of this invention to improve heat recovery systems capable of heating a liquid medium with the waste heat of a condensible, gaseous medium.

It is another object of this invention to improve heat recovery systems for heating a liquid medium by utilizing the heat discharged by a refrigeration system.

Still another object of this invention is to design a heat recovery system which may be retrofitted onto existing systems that discharge waste heat into the ambient atmosphere.

Yet another object of this invention is to employ a heat recovery system which flows a hot condensible gas in a heat exchange relationship countercurrent to the flow of a medium to be heated so that the medium to be heated first receives the heat of sub-cooling the condensed gas, then the latent heat of the gas, and finally the superheat of the gas.

It is another object of this invention to utilize the heat of a condensed gas as a heat source for the low temperature side of a liquid-to-liquid heat pump.

Still another object of this invention is to provide a heat recovery system capable of being retrofitted onto an existing refrigeration system in a manner that does not affect the operation of the refrigeration system.

Another object of this invention is to maximize the efficiency of a heat recovery system by controlling the flow of a hot, condensible gas used as a heat source and the flow of a liquid medium to be heated.

Still another object of this invention is to withdraw heat from a hot, gaseous medium during periods of low heat energy demand and store the heat in a liquid for later use during periods of high heat energy demand.

Another object of this invention is to control the energy-consuming devices in an improved heat recovery system to operate only when they will contribute to an efficient heat exchange process between a hot condensible gas and a heat-receiving medium.

To achieve these objects, and in accordance with the purposes of the invention, as embodied and broadly described herein, the heat recovery system comprises means for conveying a fluid from a fluid inlet downstream to a fluid outlet and means for circulating a superheated condensible heat exchange medium around the conveying means in a heat exchange relationship to transfer to the fluid, first, the heat sub-cooling condensed heat exchange medium, second, the latent heat of the heat exchange medium, and, finally, the superheat of the heat exchange medium.

The accompanying drawings, which are incorporated and constitute a part of the specification, illustrate an embodiment of the invention and, together with the description, serve to explain the principles of the invention.

DETAILED DESCRIPTION OF THE PREFERRED EMBODIMENT

Figure 1:
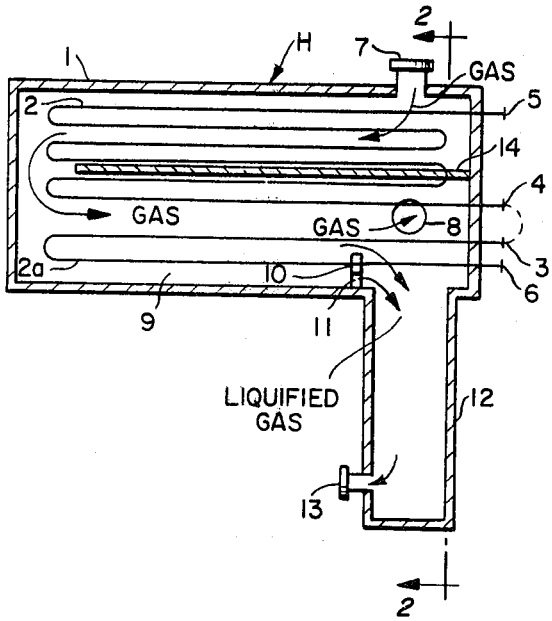
FIG. 1 is a cross-sectional view of a heat exchanger used in the heat recovery system of the instant invention.

FIG. 1 illustrates an embodiment of a heat exchanger which forms a central feature of the heat recovery system of the instant invention. The heat exchanger includes means for conveying a fluid to be heated from a fluid inlet downstream to a fluid outlet, and means for circulating a superheated condensible heat exchange medium around the conveying means in a heat exchange relationship to transfer to the fluid, first, the heat of sub-cooling condensed heat exchange medium, second, the latent heat of the heat exchange medium, and, finally, the superheat of the heat exchange medium.

As embodied herein, the circulating means comprises a vessel or shell 1, as will be described hereinafter, enclosing the conveying means. The conveying means comprises a conduit 2 formed, for example, as one or more horizontal passages or tubes arranged in a serpentine manner and extending from a fluid inlet 4 at the lower end of the conduit 2 to a fluid outlet 5 at the upper end of the conduit 2. Alternatively, a conduit extension 2*a*, arranged as one or more additional horizontal passages or tubes, can be coupled to the conduit 2 by connecting the outlet 3 of the conduit extension 2*a* to the inlet 4 of the conduit 2. When this extension 2*a* is employed, the inlet 6 to the conduit extension 2*a* performs as the fluid inlet, at a lower point than the inlet 4, while the outlet 5 continues to serve as the fluid outlet for the conveying means.

A gas inlet 7 at the top of the shell 1 receives the superheated condensible heat exchange medium from the medium source. A baffle 14, extending from the end of the shell 1 directs the flow of hot, heat exchange medium through the length of the shell 1. The medium can be exhausted through medium outlet 8 in a gaseous form. Also, condensed heat exchange medium will accumulate in a surrounding means 9 such that the condensed heat exchange medium surrounds a portion of the conduit extension 2*a*. As embodied herein, the surrounding means comprises a baffle 10, or a series of baffles, cooperating with the walls of the shell 1 to form a pool of condensed heat exchange medium in the bottom of the shell 1.

The heat recovery system further includes means for establishing a maximum depth for the pool of condensed heat exchange medium in the shell 1, and means for collecting any condensed heat exchange medium in excess of the volume of the pool. As herein embodied, the establishing means comprises a drain hole 11 selectively located in the baffle 10 to enable condensed heat exchange medium to flow from the pool into the collecting means. As embodied herein, the collecting means comprises a sump 12, optionally formed as part of the shell 1, having a condensed medium outlet 13.

With further reference to FIG. 1, it will be understood by one of ordinary skill in the art that forming a pool of condensed heat exchange medium behind the baffle 10 such that it surrounds a portion of the conduit extension 2*a* causes the fluid in the conduit extension 2*a* to be heated as it is initially supplied through inlet 6 and passes through the pool of condensed heat exchange medium. This transfers to the fluid in the conduit extension 2*a* the heat of sub-cooling the condensed heat exchange medium and will serve to increase the temperature of the fluid from the temperature at which the fluid enters the inlet 6.

As the fluid continues through the conduit extension 2*a* and the coupling (shown in dash form in FIG. 1) between conduit extension outlet 3 and the inlet 4 for the conduit 2, the fluid will be exposed to the latent heat of the heat exchange medium to a manner that will raise the temperature of the fluid to a higher degree.

Finally, as the fluid passes through the conduit 2 into the upper portion of the shell 1, the temperature of the heat exchange medium will be significantly higher because it is closer to the medium inlet 7 and, therefore, the temperature of the fluid will be elevated further.

It should be noted that a gas-directing baffle 14 extends horizontally from the walls of the shell 1 into the body of the heat exchanger. This baffle 14 causes the heat exchange medium entering the medium inlet 7 to flow through the heat exchanger above the baffle 14 and around the portion of the conduit 2 in the upper portion of the shell 1. The heat exchange medium will then travel back through the heat exchanger until the gaseous portion of the medium is exhausted through the medium outlet 8 and the condensed portion of the medium is collected in the pool of condensed heat exchange medium in the bottom of the vessel 1 including the sump 12.

In sum, the heat exchanger features a flow of heat exchange medium which is countercurrent to the flow in the heat exchanger of the fluid to be heated. The temperature of the heat exchange medium is higher, and possibly equal to the superheated temperature of a gas, at the medium inlet 7 than it is at the medium outlet 8 and in the pool of condensed medium collected in the bottom of the heat exchanger H behind the baffle 10. The flow of the fluid to be heated, however, is directly opposite to the flow of the heat exchange medium such that the fluid initially travels through the coolest heat exchange medium, i.e., the condensed heat exchange medium to the pool in the bottom of the heat exchanger. Then the fluid passes through the portion of the heat exchanger wherein the latent heat of the heat exchange medium can be transferred to it. Finally, the fluid passes through the upper portion of the heat exchanger wherein the fluid will be exposed to the highest temperature of the heat exchanger medium just before the fluid passes out of the heat exchanger through the fluid outlet 5.

This countercurrent arrangement of the heat exchanger significantly increases the efficiency of the heat exchanger by utilizing heat contributions from (1) the heat of sub-cooling the condensed heat exchange medium, (2) the latent heat of the heat exchange medium, and (3) the superheat of the heat exchange medium as it enters the vessel 1 through the medium inlet 7.

Figure 2:
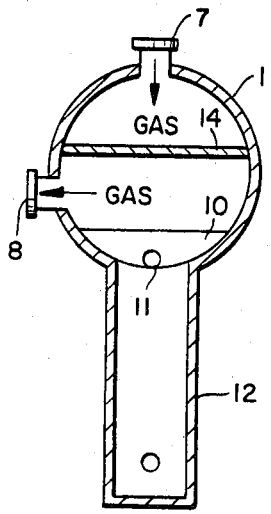
FIG. 2 is a view of the heat exchanger of FIG. 1 taken along the lines of 2—2.

FIG. 2 shows the heat exchanger of FIG. 1 without the conduit 2 and the conduit extension 2*a*. The circulating means is shown as comprising the shell 1, the gas-directing baffle 14, the medium inlet 7, and the medium outlet 8. As illustrated in FIG. 2, the heat exchange medium enters the medium inlet 7, flows around the baffle 14, and exits through the medium outlet 8. The baffle 10 forms a barrier in the lower portion of the shell 1 and serves as a dam to collect a pool of condensed heat exchange medium. The drain hole 11 directs a flow of condensed heat exchange medium into the sump 12.

Figure 3:
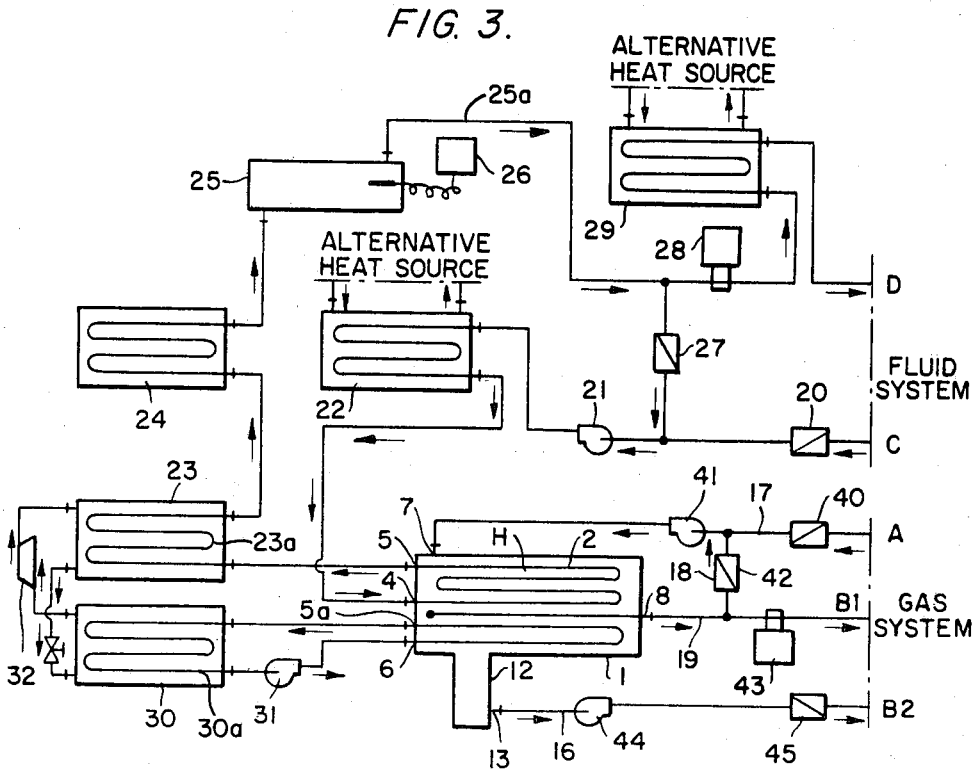
FIG. 3 illustrates the entire heat recovery system of the instant invention including the heat exchanger of FIGS. 1 and 2.

FIG. 3 illustrates a heat recovery system which employs the heat exchanger of FIGS. 1 and 2 as a means for coupling in a heat exchange relationship a liquid system to a gas system. It is contemplated that in the heat recovery system of FIG. 3, the heat exchange medium comprises a condensible gas that could, for example, comprise the refrigerant of an existing refrigeration system. It is merely necessary to connect the gas system of the heat recovery system of FIG. 3 between the compressor and the condenser of the refrigeration system such that superheated condensible gas is supplied to the gas system at a gas system source A and returned to the refrigeration system as a cooler gas at a gas system return B1 or in a condensed state at a liquid return B2.

The gas system includes means for recirculating the heat exchange medium, i.e. the condensible gas, between the source of the condensible gas (the refrigeration system) and the vessel 1. As herein embodied, the recirculating means comprises a heat exchange medium supply line 17 coupling the gas system source A to the medium inlet 7. The recirculating means further comprises a supply pump 41 and a supply valve 40 which together enable the volume and pressure of the medium flow to be selected and controlled.

A bypass conduit 18 connects the medium outlet 8 to the heat exchange medium supply line 17 through a bypass valve 42 so that if the temperature of the medium as discharged through the medium outlet 8 is sufficiently high to enable additional heat transfers to a fluid flowing through the conduit 2 in the heat exchanger H, the valve 42 can be opened to form a continuous loop between the medium inlet 7 and the medium outlet 8. If the valve 42 is closed, the medium will be returned at the gas system return B1 to the refrigeration system under the control of a flow switch 43.

A heat exchange medium discharge line 16 couples the outlet 13 of the sump 12 to the liquid return B2 through a pump 44 and a valve 45. Thus, the condensed heat exchange medium can be exhausted from the sump 12 at a rate controlled by the pump 44 and the valve 45.

The liquid system of the heat recovery system of FIG. 3 is an example of one of many liquid systems that could be utilized with the heat exchanger. In the particular liquid system illustrated in FIG. 3, additional heat exchangers and heat sources may be used to increase the temperature after the fluid exits the fluid outlet 5 of the heat exchanger H. Nevertheless, the liquid system could be as simple as a source of liquid to be heated, e.g., a water tip which supplies the fluid to either the fluid inlet 6 of the conduit extension 2*a* or the fluid inlet 4 of the conduit 2. The heated fluid as it is discharged through the fluid outlet 5 could be directly supplied to a fluid storage device or to a device which immediately uses the heated fluid.

According to FIG. 3, however, the fluid supplied to the fluid system at a fluid supply C enters the heat exchanger through a fluid check valve 20, a fluid pump 21, and an optional heat exchanger 22. The heat exchanger 22 is coupled to a low temperature, alternative heat source, such as a solar collector, and determines the temperature of the fluid as it enters the heat exchanger H through either the fluid inlet 6 of the conduit extension 2*a* or the fluid inlet 4 of the conduit 2.

According to the fluid system of FIG. 3, fluid is supplied to the fluid inlet 4 of the conduit 2 and the heated fluid is discharged through the fluid outlet 5. The conduit extension 2*a* is not connected to the conduit 2 but has a discharge 5*a*. The conduit extension 2*a* is used as a low temperature heat source for the low temperature side of a refrigerant compressor 32 through the utilization of a heat exchanger 30. The heat exchanger 30, in a manner well-known in the art, employs its own heat exchange liquid which will be in a heat exchange relationship with the fluid passing through the pool of condensed heat exchange medium in the heat exchanger H. Such liquid-to-liquid heat exchangers are well-known in the art.

The heated fluid discharged from the heat exchanger H through the fluid outlet 5 enters the heat exchanger 23, the high temperature side of a refrigerant compressor 32. The refrigerant compressor 32 is employed to further raise the temperature of the fluid passing through the heat exchanger 23. From the high side heat exchanger 23, the fluid passes through an optional thermal heat storage device 24 and a liquid medium accumulation tank 25. The fluid also passes through a flow switch 28 and an optical heat exchanger 29 that utilizes a high temperature heat source. A portion of the fluid or the entire fluid flow can be recirculated through the check valve 27, the pump 21, and the heat exchanger 22 to the fluid inlet 4 of the heat exchanger H. All or a portion of the fluid can also be withdrawn from the fluid system at a fluid system outlet D.

A further feature of the heat recovery system as illustrated in FIG. 3 is that a thermostat 26 measures the temperature of the fluid stored in the fluid storage device 25 and generates control signals, in a manner well-known in the art, to position the check valve 27 in a manner that will automatically enable the recirculation of all or a portion of the fluid stored in the thermal storage device 25 through the heat exchanger H if the temperature in the fluid storage device 25 drops below a set temperature. This feature of the heat recovery system also enables the pump 21 to be shut down in order to save additional energy whenever the temperature of the fluid stored in the fluid storage device 25 is within a certain desired range and no new fluid is being supplied to the fluid system at the fluid system supply C.

Another feature of the heat recovery system, as illustrated in FIG. 3, is that the fluid check valve 20 and the fluid pump 21 are controllable to compensate for aerodynamical and hydro-dynamical losses within the system. By adjusting the flow rates of the valve 20 and the pump 21, fluid pressure drops and flow variations arising from the inclusion or exclusion of one or more of the refrigerant compressor 32, the thermal storage device 24, the fluid storage tank 25, the high temperature source 29, the low temperature source 22, or any other device can be compensated for and prevented from unbalancing the fluid system of the heat recovery system.

Similarly, the valve 40 and pump 41 are controllable to compensate for pressure drops in the medium flow caused by the heat exchanger H. Moreover, the ability to control in a dynamic manner the fluid valve 20, fluid pump 21, valve 40 and pump 41 to match the fluid and gas flow rates maximizes the efficiency of the heat recovery system.

Figure 4:
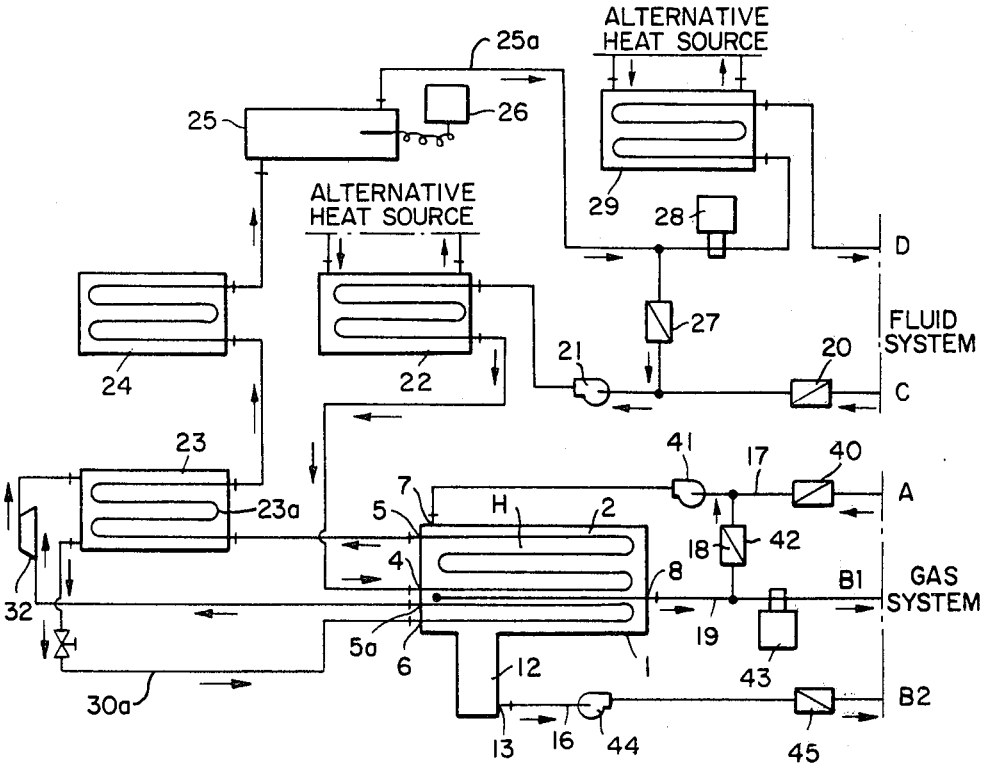
FIG. 4 illustrates an alternate embodiment of the heat recovery system of the instant invention.

As illustrated in FIG. 4, the fluid-to-fluid refrigerant conpressor 32 can alternatively use the conduit extension 2*a* of the heat exchanger H as a heat source directly in order to eliminate the need for the low temperature side heat exchanger 30. This enables the low temperature heat of the heat exchanger H, i.e., the latent heat of condensation of the heat exchange medium, to be converted by the refrigerant compressor 32 directly into high temperature heat for transfer by the high temperature side of the heat exchanger 23 to the fluid after the fluid has been discharged from the fluid outlet 5 of the heat exchanger H. The result of such a configuration is to increase further the amount of energy transferred from the heat exchange medium, thus, increasing the efficiency of heat transfer. Also, utilizing the heat of the heat exchange medium directly as a heat source for the refrigerant compressor 32 reduces the number of components necessary in the fluid system illustrated in FIG. 3.

The foregoing describes a heat recovery system which could be easily retrofitted onto existing refrigeration systems to utilize heat that is normally discharged into the ambient atmosphere. The valve 40 and the pump 41 in cooperation with the valve 43, the pump 44, and the valve 45 are controllable to compensate for any pressure drop for the heat exchange medium as it passes through the heat exchanger H. Thus, the heat recovery system of the instant invention is adjustable so that it will not impact deleteriously on the operation of a refrigeration system used as a source of a superheated condensible heat exchange medium. Furthermore, it is not necessary that the medium, as supplied at gas system supply A, be superheated nor condensible in order for the principle of the heat exchanger H to operate effectively. This is because the heat exchanger H will also expose the fluid at its coldest temperature to the heat exchange medium at its coolest temperature. The countercurrent flow of the fluid and the heat exchange medium ensures that the fluid will be constantly exposed to an increasing temperature of the heat exchange medium. Thus, a greater amount of heat can be transferred from the heat exchange medium to the fluid.

It will be further apparent to those skilled in the art, that various modifications can be made to the recovery system of the instant invention without departing from the scope or spirit of the invention, and it is intended that the present invention cover the modifications and variations of the system provided that they come within the scope of the appended claims and their equivalents.

What is claimed is:

1. A system for heating a fluid from heat released during the condensing of a superheated condensible heat exchange medium supplied by a source of such medium, the system comprising:

means for conveying said fluid in a first direction from a fluid inlet downstream to a fluid outlet; and means for circulating said heat exchange medium around said conveying means in the opposite direction in a heat exchange relationship to transfer to said fluid, first, the heat of subcooling condensed heat exchange medium, second, the latent heat of said heat exchange medium, and, finally, the superheat of said heat exchange medium, whereby said heat exchange medium flows countercurrent to the flow of said fluid such that said fluid is initially exposed to the heat exchange medium at the coolest temperature thereof and is thereafter exposed to said heat exchange medium having a continuously increasing temperature until said fluid flows from said fluid outlet.

2. A system for heating a fluid from heat released during the condensing of a superheated condensible heat exchange medium supplied by a source of such medium, the system comprising:

means for conveying said fluid from a fluid inlet downstream to a fluid outlet; and means for circulating said heat exchange medium around said conveying means in a heat exchange relationship to transfer to said fluid, first, the heat of subcooling condensed heat exchange medium, second, the latent heat of said heat exchange medium, and finally, the superheat of said heat exchange medium, said circulating means comprising a vessel enclosing said conveying means from said fluid inlet to said fluid outlet, said vessel including a medium inlet proximate said fluid outlet for receiving said heat exchange medium prior to said heat exchange with said fluid, and a medium outlet upstream of said fluid outlet for discharging said heat exchange medium from said vessel after said heat exchange with said fluid, the temperature of said heat exchange medium being higher at said medium inlet than at said medium outlet; and means for directing said heat exchange medium flow between said medium inlet and said medium outlet.

3. A system according to claim 2 wherein said directing means comprises a first baffle in said vessel.

4. A system according to claim 3 wherein said circulating means further comprises means for surrounding said conveying means proximate said fluid inlet with condensed heat exchange medium to transfer the heat of sub-cooling said condensed heat exchange medium to said fluid.

5. A system according to claim 3 wherein said surrounding means comprises a second baffle cooperating with the walls of said vessel to form in said vessel a pool of condensed heat exchange medium through which said fluid is passed by said conveying means upon reception through said fluid inlet.

6. A system according to claim 5 further comprising:

means for establishing a maximum depth for said pool of condensed heat exchange medium in said vessel; and means for collecting any condensed heat exchange medium in excess of said volume of said medium in said pool.

7. A system according to claim 6 wherein said establishing means comprises an opening selectively located in said second baffle through which said condensed heat exchange medium may drain to said collecting means.

8. A system according to claim 6 wherein said collecting means comprises a sump, said sump having an outlet for discharging said collected condensed heat exchange medium.

9. A system according to claim 5 wherein said conveying means comprises a conduit connecting said fluid inlet to said fluid outlet.

10. A system according to claim 2 further including means for maintaining the flow of said fluid though said conveying means at a predetermined pressure and volume.

11. A system according to claim 10 wherein said maintaining means comprises a fluid pump for establishing the pressure of said fluid flow and a fluid valve for selecting the volume of said fluid flow.

12. A system according to claim 2 further including means for recirculating said heat exchange medium between said source and said vessel.

13. A system according to claim 12 wherein said recirculating means comprises:

a heat exchange medium supply line coupling said source of said superheated medium to said medium inlet;

a supply pump in said supply line for supplying said heat exchange medium at a substantially constant pressure to said medium inlet; and a supply valve in said supply line for supplying said medium to said medium inlet at a substantially constant flow rate.

14. A system according to claim 13 further including a bypass conduit connecting said medium outlet to said medium inlet, and a bypass valve in said bypass conduit, said bypass valve when opened for selectively recirculating said medium discharged from said medium outlet to said medium inlet without return to said medium source and for enabling when closed the circulation of said medium discharged from said medium outlet to said source.

15. A system according to claim 13 wherein said recirculating means further comprises a heat exchange medium discharge line coupling said sump outlet to said medium source to supply said condensed heat exchange medium collected to said sump to said source.

16. A system for heating a fluid with heat released during the cooling of a superheated heat exchange medium received from a source of the medium comprising:

means for conveying said fluid from a fluid inlet downstream to a fluid outlet; and means for circulating said heat exchange medium around said conveying means in a heat exchange relationship to expose said conveying means first to the latent heat of said heat exchange medium and then to the superheat of the said heat exhange medium, said circulating means comprising:

a vessel enclosing said conveying means from said fluid inlet to said fluid outlet, said vessel having a medium inlet proximate said fluid outlet for receiving said medium prior to heat exchange with said fluid;

a medium outlet upstream of said fluid outlet for discharging said medium after heat exchange with said fluid, the temperature of said medium being higher at said medium inlet than at said medium outlet; and means for directing said condensible medium to flow from said medium inlet to said medium outlet.

17. A system as in claim 16 wherein a portion of said heat exchange medium is condensed in said vessel and wherein said system further includes:

a baffle cooperating with the interior walls of said vessel to collect in said vessel a pool of condensed heat exchange medium;

means for establishing a maximum depth for said pool of condensed heat exchange medium; and means for collecting any condensed heat exchange medium in excess of the volume contained in said pool.

18. A system as in claim 17 further including:

a liquid-to-liquid heat pump having a low temperature side and a high temperature side; and a first heat exchanger for supplying heat to said low temperature side of said heat pump, said first heat exchanger including a first coil filled with a heat exchange liquid and extending into said pool of condensed heat exchange medium in said vessel in a heat exchanging relationship such that said heat exchange liquid is heated by the heat of sub-cooling said condensed heat exchange medium.

19. A system as in claim 18 further including a second heat exchanger including a second coil for receiving said fluid discharged at said fluid outlet, said second coil being in a heat exchanging relationship with said high temperature side of said heat pump such that addition heat generated by said heat pump is transferred to said fluid.

20. A system as in claim 17 further including a liquid-to-liquid heat pump having a low temperature side and a high temperature side, said low temperature side including a first coil filled with a heat exchange liquid, said first coil extending into said pool of condensed medium in said vessel in a heat exchanging relationship therewith to supply directly the heat of sub-cooling said condensed medium and at least a portion of said latent heat to said low temperature side of said heat pump.

21. A system as in claim 20 further including:

a storage tank for storing fluid discharged from said high temperature side heat exchanger coil;

a fluid conduit coupling said storage tank to said fluid inlet;

a valve in said fluid conduit to control the flow of said fluid therethrough, said valve when opened enabling the transfer of said fluid from said storage tank through said fluid conduit to said fluid inlet and when closed preventing fluid from flowing through said fluid conduit; and means for sensing the temperature of said fluid in said storage tank and for controlling the opening of said valve if said sensed temperature is below a predetermined temperature whereby said fluid is permitted to flow through said vessel and said high temperature side heat exchanger to raise the temperature of said fluid.

22. A system as in claim 20 further including means for balancing the flow rate of said fluid with the flow rate of said medium and for compensating for any aerodynamical and hydrodynamical losses in said fluid flow and said medium flow.

23. A system according to claim 1 wherein said conveying means comprises a conduit connecting said fluid inlet to said fluid outlet.

* * * * *